US011136887B2

(12) United States Patent
Abel

(10) Patent No.: US 11,136,887 B2
(45) Date of Patent: Oct. 5, 2021

(54) MINE ROOF SUPPORT, PRE-INSTALLATION ASSEMBLY FOR SAME, AND METHOD OF INSTALLATION

(71) Applicant: Burrell Mining Products, Inc., New Kensington, PA (US)

(72) Inventor: Don C. Abel, Lower Burrell, PA (US)

(73) Assignee: Burrell Mining Products, Inc., New Kensington, PA (US)

( * ) Notice: Subject to any disclaimer, the term of this patent is extended or adjusted under 35 U.S.C. 154(b) by 0 days.

(21) Appl. No.: 16/844,656

(22) Filed: Apr. 9, 2020

(65) Prior Publication Data

US 2020/0325776 A1 Oct. 15, 2020

Related U.S. Application Data

(60) Provisional application No. 62/832,412, filed on Apr. 11, 2019.

(51) Int. Cl.
*E21D 15/30* (2006.01)
*E21D 15/502* (2006.01)
*E21D 15/14* (2006.01)

(52) U.S. Cl.
CPC ..... *E21D 15/14* (2013.01); *E21D 15/30* (2013.01); *E21D 15/502* (2013.01)

(58) Field of Classification Search
CPC ..... E21D 15/14; E21D 15/30; E21D 15/303; E21D 15/306; E21D 15/502
USPC ..... 405/288, 289
See application file for complete search history.

(56) References Cited

U.S. PATENT DOCUMENTS 3,001,808 A 9/1961 Frye
4,570,397 A 2/1986 Creske
5,143,340 A * 9/1992 Wood ..... E04G 21/0472 248/354.2
5,308,196 A 5/1994 Frederick
5,921,718 A 7/1999 Kolk
6,056,480 A 5/2000 Kolk
6,394,707 B1 5/2002 Kennedy et al.
(Continued)

FOREIGN PATENT DOCUMENTS

DE 4402358 A1 8/1995
GB 191317885 A * 11/1913 ..... E21D 15/18
(Continued)

OTHER PUBLICATIONS

International Search Report for International Application No. PCT/US2020/027472, dated May 27, 2020, 5 pages.
(Continued)

*Primary Examiner* — Frederick L Lagman
(74) *Attorney, Agent, or Firm* — TraskBritt

(57) ABSTRACT

A mine roof support comprises two or more frusto-conical, tubular sections, the sections each flared outwardly from an upper end to a lower end thereof, a skirt portion of a section being received and secured within a neck portion of a section below in a frictional fit to define a continuous, interior volume of the mine roof support. A continuous, solid, compressible, load-bearing material is located within the interior volume. An uppermost section is closed at an upper end thereof, and a lowermost section is closed at a lower end thereof. Methods of installing a mine roof support and a pre-installation assembly for a mine roof support are also disclosed.

32 Claims, 7 Drawing Sheets

(56) References Cited

U.S. PATENT DOCUMENTS

| | | | | |
|---|---|---|---|---|
| 8,246,276 | B2 | 8/2012 | Bower et al. | |
| 8,821,075 | B2 | 9/2014 | Mccartney et al. | |
| 8,851,805 | B2 | 10/2014 | Shook et al. | |
| 9,181,801 | B2 | 11/2015 | Faulkner | |
| 9,347,316 | B2 | 5/2016 | Shook et al. | |
| 2006/0278476 | A1* | 12/2006 | Kroeger | E04C 3/005 188/67 |
| 2007/0267559 | A1* | 11/2007 | Spearing | E21D 15/43 248/354.1 |
| 2012/0243945 | A1 | 9/2012 | Swingler et al. | |
| 2012/0269585 | A1 | 10/2012 | Faulkner | |
| 2014/0064859 | A1* | 3/2014 | Shook | E21D 15/486 405/290 |
| 2014/0348596 | A1 | 11/2014 | Hussey et al. | |
| 2015/0097099 | A1 | 4/2015 | Barnett et al. | |
| 2015/0147122 | A1* | 5/2015 | Faulkner | E21D 15/55 405/288 |
| 2015/0184512 | A1* | 7/2015 | Shook | E21D 15/523 405/289 |
| 2017/0130580 | A1 | 5/2017 | Shook et al. | |
| 2019/0203597 | A1 | 7/2019 | Abel et al. | |

FOREIGN PATENT DOCUMENTS

| | | | |
|---|---|---|---|
| WO | 2000/011318 | A1 | 3/2000 |
| WO | 2017/147262 | A1 | 8/2017 |

OTHER PUBLICATIONS

International Written Opinion for International Application No. PCT/US2020/027472, dated May 27, 2020, 5 pages.

* cited by examiner

MINE ROOF SUPPORT, PRE-INSTALLATION ASSEMBLY FOR SAME, AND METHOD OF INSTALLATION

CROSS-REFERENCE TO RELATED APPLICATIONS

This application claims the benefit under 35 U.S.C. § 119(e) of U.S. Provisional Patent Application Ser. No. 62/832,412 filed Apr. 11, 2019, the disclosure of which is hereby incorporated herein in its entirety by this reference.

TECHNICAL FIELD

Embodiments of the present disclosure relate to mine roof supports. More particularly, embodiments of the present disclosure relate to a telescoping mine roof support configured for extension responsive to introduction under pressure to an interior of the support of a flowable filler material precursor which subsequently reaches a solid state in the interior of the support, a pre-installation assembly for the support, and a method of installation.

BACKGROUND

Mine roof supports of various types are well known. One very successful mine roof support is disclosed in U.S. Pat. No. 5,308,196 and marketed as THE CAN® support, by Burrell Mining Products, Inc. of New Kensington, Pa. This support comprises a one-piece outer metal housing filled with a compressible load-bearing material, such as grout. Other mine roof supports include telescoping assemblies of several cylindrical tubular sections which are extended between a mine floor and roof. Some such supports may be filled with a material such as grout, which hardens into a solid, load-bearing, compressible material. Examples of such a support are disclosed and claimed in U.S. Pat. No. 8,851,805, assigned to the assignee of the present application, and the disclosure of which is hereby incorporated herein in its entirety by this reference.

Another mine roof support is disclosed and claimed in U.S. patent application Ser. No. 15/940,826, filed Mar. 29, 2018, now U.S. Pat. No. 10,822,948, issued Nov. 3, 2020, and entitled "MINE ROOF SUPPORT, PRE-INSTALLATION ASSEMBLY FOR SAME, AND METHOD OF INSTALLATION," assigned to the assignee of the present invention, and the disclosure of which is hereby incorporated herein in its entirety by this reference. Such mine roof support employs multiple, nested, frusto-conical tubular sections that are extendable in a telescoping fashion, the uppermost section secured to a mine roof, and the support subsequently filled with a flowable filler material such as, for example, a cementitious grout. This mine roof support offers the advantages of being lightweight and compact for transport to, and handling in, a mine as well as the establishment of substantially fluid-tight seals between adjacent sections due to the friction fit enabled by the frusto-conical sections when mutually extended.

BRIEF SUMMARY

In some embodiments, a mine roof support comprises two or more frusto-conical, tubular sections, the sections each flared outwardly from an upper end to a lower end thereof, a skirt portion of a section being received and secured within a neck portion of a section below in a frictional fit providing a substantially fluid-tight seal between sections to define a continuous volume within the secured sections. A continuous, solid, compressible, load-bearing filler material is located within the continuous interior volume. A lowermost frusto-conical tubular section includes a floor at the bottom of the skirt sealing the bottom of the lowermost frusto-conical tubular section, and an uppermost frusto-conical tubular section includes a cap sealing a mouth of the neck of an uppermost frusto-conical tubular section.

In other embodiments, a method of installing a mine roof support comprises placing a mine roof support comprising at least two sections in an installation location, each of the at least two sections of frusto-conical configuration and flared outwardly from an upper end to a lower end thereof, at least one of the at least two sections being nested within at least one other of the two or more sections. An outermost frusto-conical tubular section includes a floor at a bottom thereof, and an innermost frusto-conical tubular section includes a cap sealing a mouth at a top of an uppermost frusto-conical tubular section. A flowable filler material precursor of a solid, compressible, load-bearing material is introduced under pressure into an interior volume of the at least two nested sections to cause an innermost section of the at least two sections to be driven upwardly within a next adjacent section until an outer surface of the lower end of the innermost section contacts and frictionally engages with an inner surface of the next adjacent section to secure the innermost section to the next adjacent section.

In further embodiments, a pre-installation assembly for a mine roof support comprises multiple tubular, frusto-conical sections in a nested arrangement, a skirt portion of each section defining a larger diameter than a neck portion of a next outer adjacent section, wherein each section is flared outwardly from an upper end to a lower end thereof at substantially the same angle $\alpha$ of departure to a longitudinal axis of the section. An innermost frusto-conical tubular section is closed proximate an upper end thereof and an outermost frusto-conical tubular section is closed proximate a lower end thereof.

DETAILED DESCRIPTION

Figure 1A:
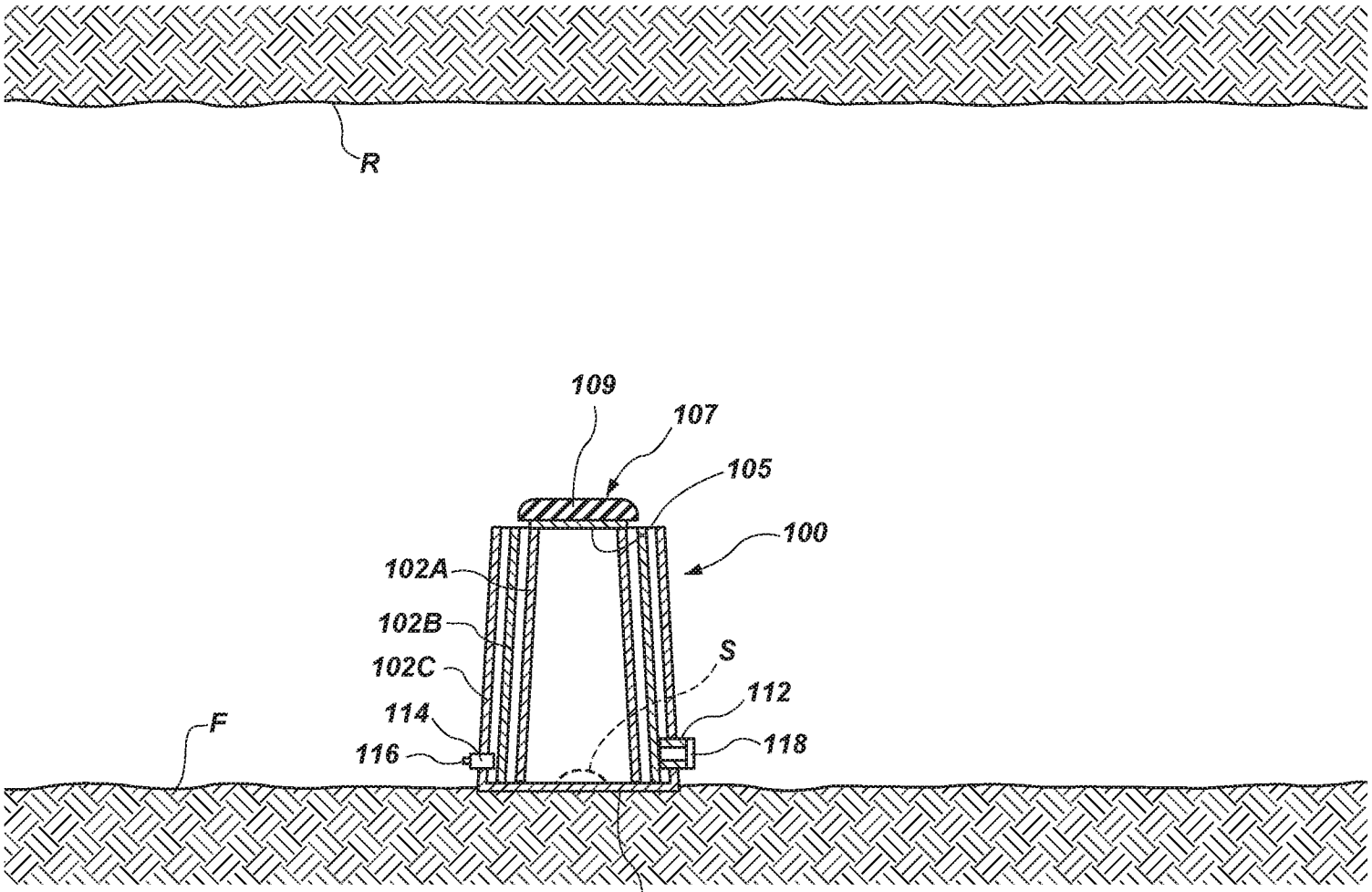
FIG. 1A is a schematic side sectional elevation of an embodiment of a mine roof support of the disclosure as placed in a room of an underground mine for installation.

The illustrations presented herein are not actual views of any particular mine roof support or method of installation, but are merely idealized representations that are employed to describe embodiments of the present disclosure.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles between surfaces that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the terms "longitudinal," "vertical," "lateral," and "horizontal" are in reference to a major plane of a substrate (e.g., base material, base structure, base construction, etc.) in or on which one or more structures and/or features are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the terms "configured" and "configuration" refer to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

Referring to FIGS. 1A through 1D, and FIG. 3, an embodiment of a mine roof support of the disclosure is described below.

Mine roof support 100 comprises two or more sections 102 of tubular, frusto-conical metal sheathing. Each section 102 may, for example, be formed of steel, rolled into a desired frusto-conical configuration and welded along a seam that extends from an upper end to a lower end thereof to form a truncated conical structure with circular upper and lower ends and no out of round portions significant enough to impair a substantial interference fit between sections 102 when mine roof support is telescopically extended. A non-limiting example of a suitable metal material for the sheathing is AISI 1008 HRS carbon steel, of between 0.062 in. (16 ga.) and 0.109 in. (12 ga.) wall thickness. As shown, mine roof support 100 comprises three sections, 102A, 102B and 102C, referenced from innermost section 102A to outermost section 102C as nested together in a collapsed assembly on floor F of a room of an underground mine, such as, but not limited to, a coal mine. The configuration of each section 102 is such that an upper end 104 thereof is of slightly smaller diameter than a lower end 106 thereof, and the lower end 106 thereof is of slightly greater diameter than the upper end of a next-outermost section 102. With reference to the longitudinal axis L of the mine roof support 100 support and of each section 102 (see FIG. 3), an acute angle $\alpha$ of departure of a wall 108 of each section is extremely small, on the order of, by way of non-limiting example, about 0.01° to about 3°. Angle $\alpha$ is exaggerated greatly in FIGS. 1A through 1D and in FIGS. 2 and 3 for clarity, as is the thickness of the metal sheathing of sections 102A-102C. Each of sections 102A, 102B and 102C may be of substantially the same height and exhibit substantially the same angle $\alpha$ of departure. Outermost section 102C, of largest diameter, may have a floor 103 of the same metal material as the metal sheathing, welded at its perimeter to the lower end 106 of section 102C, closing section 102C proximate the lower end. Similarly, innermost section 102A, of smallest diameter, may have a cap 105 of the same metal material as the metal sheathing, welded at its perimeter to the upper end 104 of section 102A, closing section 102A proximate the upper end 104. In addition, a cover 107 of a relatively thick (e.g., three to four inches) solid compressible material may be secured over cap 105 by, for example, an adhesive. In some embodiments, cover 107 may comprise an inflatable grout bag of, for example, a high-strength geotextile, to be inflated (i.e., filled) independently from mine roof support 100 with a cementitious material, aerated or unaerated, or a self-hardening foam, once mine roof support 100 is extended into close proximity with mine roof R. Alternatively, the grout bag may be inflated through an aperture in cap 105, the aperture being closed by a rupturable diaphragm designed to rupture at a predetermined pressure responsive to full extension of mine roof support. In other embodiments, the cover 107 may comprise, for example, wood, or a preformed high density foam material such as, for example, a polyurethane. In some embodiments, cap 105 may be sized to correspond to a mouth of an upper end 104 of section 102A and include a downwardly extending annular skirt configured to fit snugly over and around the upper end of section 102A to facilitate welding of cap 105 to the wall 108 of section 102A. FIG. 3 does not show floor 103, cap 105 or cover 107, depicting only a frusto-conical portion of sections 102A, 102B and 102C.

Figure 1B:
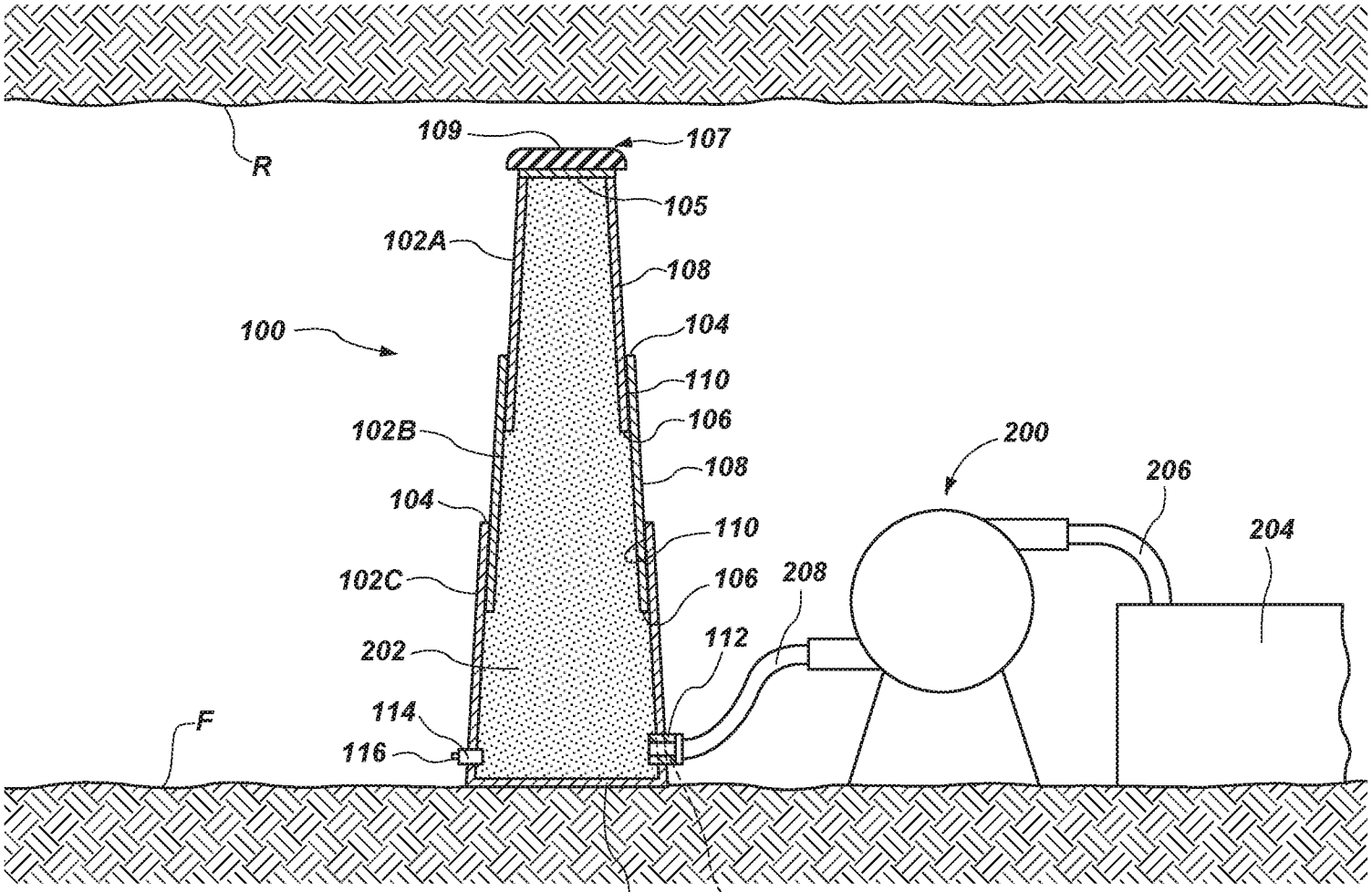
FIG. 1B is a schematic side sectional elevation of the mine roof support of FIG. 1A, partially extended in a telescoping fashion between the floor and roof of the underground mine room responsive to introduction of a flowable filler material precursor under pressure into the interior of the support.

Referring to FIG. 1B of the drawings, mine roof support 100 has been partially extended, which may also be characterized as telescoped, upwardly from mine floor F toward mine roof R. As shown in FIG. 1B, the lower end 106 of section 102A is captured within the upper end 104 of section 102B. Stated another way, and referring to FIG. 3, the skirt portion of wall 108 above the lower end 106 of section 102A is captured and frictionally engaged about an entire exterior circumference within an entire interior circumference of a neck portion 110 below the upper end 104 of section 102B in what may be characterized as a substantial interference fit effecting a substantially fluid-tight seal. Section 102B is shown partially extended, or telescoped, within and with respect to section 102C. An exterior circumference of skirt portion of wall 108 substantially above the lower end 106 of section 102B is captured within an interior circumference of the neck portion 110 below the upper end 104 of section 102C in slidable relation to section 102C. The slight angle $\alpha$ of the frusto-conical sections 102A-102C enables a friction fit between the skirt portion of wall 108 of a section 102 and the neck portion 110 of a next-lower section 102 when the two adjacent sections 102 of mine roof support 100 are mutually extended to frictionally engage, providing a substantially fluid-tight seal between the two sections 102.

Still referring to FIG. 1B, mine roof support 100 is partially extended in a telescoping fashion by filling with a flowable medium 202 under pressure, for example a flowable compressible material precursor in the form of a slurry of a cementitious grout. The grout may or may not be aerated or "foamed," either by introduction of gas into the grout or by use of a chemical additive to initiate a reaction to create closed gas cells; in such a case the grout may also be characterized as a cellular cementitious material. Alternatively, a self-hardening foam material may be employed. In either instance, flowable medium 202 is introduced into the open, continuous interior volume of mine roof support, until the entire mine roof support is filled with the flowable medium 202 and extended by the continuous, pressurized flowable medium at least into close proximity to, or in contact with, mine room roof R. As shown, pump 200 draws the flowable medium 202 from flowable medium source 204 through a conduit 206, such as a hose, and pressurizes flowable medium 202 which is directed into an inlet port coupling 112 in section 102C of mine roof support 100 via another conduit 208 which is coupled to inlet port coupling 112 in a pressure-tight manner. Floor 103 of lowermost section 102C prevents the flowable medium 202 from exiting the bottom of mine roof support 100. Similarly, cap 105 prevents the flowable medium 202 from exiting the top of mine roof support 100, containing flowable medium 202 under pressure to lift section 102A within section 102B until the two are mutually frictionally engaged about their respective circumferences and, in turn when section 102A is fully extended and section 102B is filled with flowable medium 202, to fill section 102C and lift section 102B upwardly until the two are mutually frictionally engaged about their respective circumferences and mine roof support 100 is substantially completely filled and extended between floor F and roof R of the mine room. As shown, an optional vent assembly 114 may be located proximate the bottom of section 102C to enhance venting of air from within mine roof support 100 as the air is displaced by the flowable medium 202. Such a feature may be unnecessary as air may vent between adjacent sections 102 during filling of mine roof support with flowable medium 202 until each section 102 is frictionally engaged with one or more adjacent sections 102. However, vent assembly 114 may be configured as an overpressure valve to release internal pressure within filled and fully extended mine roof support to prevent damage to (e.g., rupture of) sheathing of one or more sections 102 responsive to internal pressure of flowable medium 202, particularly along a weld seam. When mine roof support 100 is completely filled with flowable medium 202 and a predetermined internal threshold pressure reached, vent assembly 114 may open valve 116. Valve 116 may, in some embodiments, comprise a spring-loaded valve plunger biased against internal pressure, outward displacement of which plunger may be observed and pumping of the flowable medium ceased. As another approach, a pressure sensor may be employed in association with conduit 208 in operable communication with pump 200 to shut down pump 200 at a predetermined internal conduit pressure. As yet another approach and in lieu of vent assembly 114 or a conduit pressure sensor, exterior surface of, for example, section 102B may be marked with a clearly visible indicia, such as a red circumferential line, near lower end 106 thereof, to indicate complete filling and full extension of mine roof support 100. Alternatively, the indicia may comprise a longitudinally extending line, marked with at, for example, one inch increments designated −3, −2, −1 and 0 as section 102B is extended, to forewarn the operator of an imminent need to shut off pump 200 when "0" is reached. It should be noted that filling mine roof support 100 with a flowable medium 202, since flowable medium 202 will fill from the bottom of mine roof support 100 upwardly, will force the skirt portion of wall 108 of each section 102 outwardly and more firmly against the neck portion 110 of a next-lower section 102. Once mine roof support 100 has been completely filled with flowable medium 202, inlet port coupling 112 may be closed with a check valve pre-installed within inlet port coupling 112 or with another type of valve (e.g., ball valve, flapper valve) integral with inlet port coupling 112 (such structures being indicated by generic reference numeral 118) may be used to prevent back flow of flowable medium 202 once pump 200 is stopped.

Referring again to FIG. 3 in conjunction with FIG. 1A, to enhance the telescopic extension of mine roof support 100 responsive to introduction of the flowable medium 202 under pressure, it is contemplated that (referring to FIG. 1A), that each of sections 102A and 102B may optionally include one or more scalloped apertures S, as shown, to facilitate flow of the flowable medium 202 from inlet port coupling 112 into the interior of section 102A and subsequently, as section 102A moves upwardly, into the interior of section 102B. Scalloped apertures S may facilitate flow of a flowable medium in the form of, for example, a cementitious grout, whether or not aerated. One scalloped aperture S is shown in broken lines in FIG. 1A and in FIG. 3. Notably, the longitudinal height of each such scalloped aperture may be minimal, for example one inch or less, so as to not compromise complete, circumferential frictional engagement of the skirt portion of wall 108 of a section 102 with an inner surface of wall 108 of neck portion of a next lower adjacent section to form a substantially fluid-tight seal.

Figure 1C:
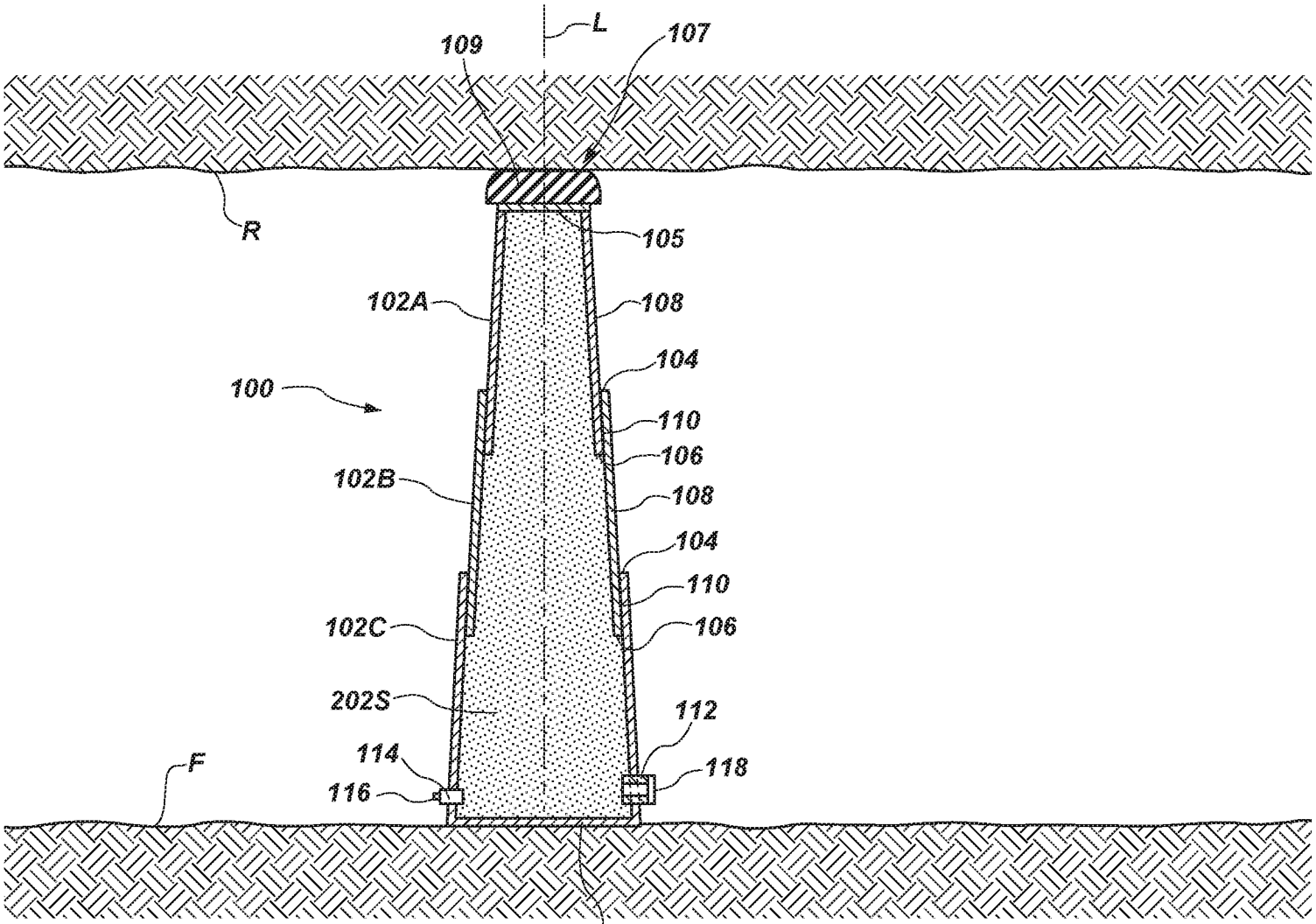
FIG. 1C is a schematic side sectional elevation of the mine roof support of FIGS. 1A through 1C, filled with grout, which is now set.

Referring to FIG. 1C of the drawings, mine roof support 100 filled with flowable medium 202 has been extended, which may also be characterized as telescoped, upwardly along longitudinal axis L from mine floor F to and in contact with mine roof R by the pressurized flowable medium 202. As shown in FIG. 1C, the exterior circumference of lower end 106 of section 102A is captured within interior circumference of the upper end 104 of section 102B. Stated another way, and referring to FIGS. 1C and 3, the skirt portion of wall 108 proximate and above the circumference of lower end 106 of section 102A is captured and frictionally engaged within the circumference of a neck portion 110 below the upper end 104 of section 102B in what may be characterized as a substantial interference fit, providing a substantially fluid-tight seal. Section 102B is shown extended, or telescoped, within and with respect to section 102C. The exterior circumference of skirt portion of wall 108 proximate and above the lower end 106 of section 102B is captured within the interior circumference of neck portion 110 below the upper end 104 of section 102C in frictional engagement with section 102C in what may be characterized as a substantial interference fit, providing a substantially fluid-tight seal. The slight angle α of the frusto-conical sections 102A-102C enables a friction fit between the skirt portion of wall 108 of each section 102 and the neck portion 110 of a next-lower section 102 when mine roof support 100 is extended to substantially a design height, providing the previously referenced substantially fluid-tight seal between each two, mutually adjacent, frictionally engaged sections 102. Optional cover 107 over cap 105 sealing the top of section 102 is in contact with roof R of the mine room, and an upper surface 109 of cover 107 may be conformed under pressure applied by flowable medium 202 to telescope mine roof support to irregular surface topography of roof R. Flowable medium 202 may cure or otherwise harden over time to provide a solid, compressible, load-bearing filler material 202S extending between floor 103 and cap 105 of mine roof support 100, any clearance between cap 105 and mine roof R being accommodated by cover 107 having upper surface 109 in substantially complete conformal contact with the surface topography of mine roof R.

Figure 1D:
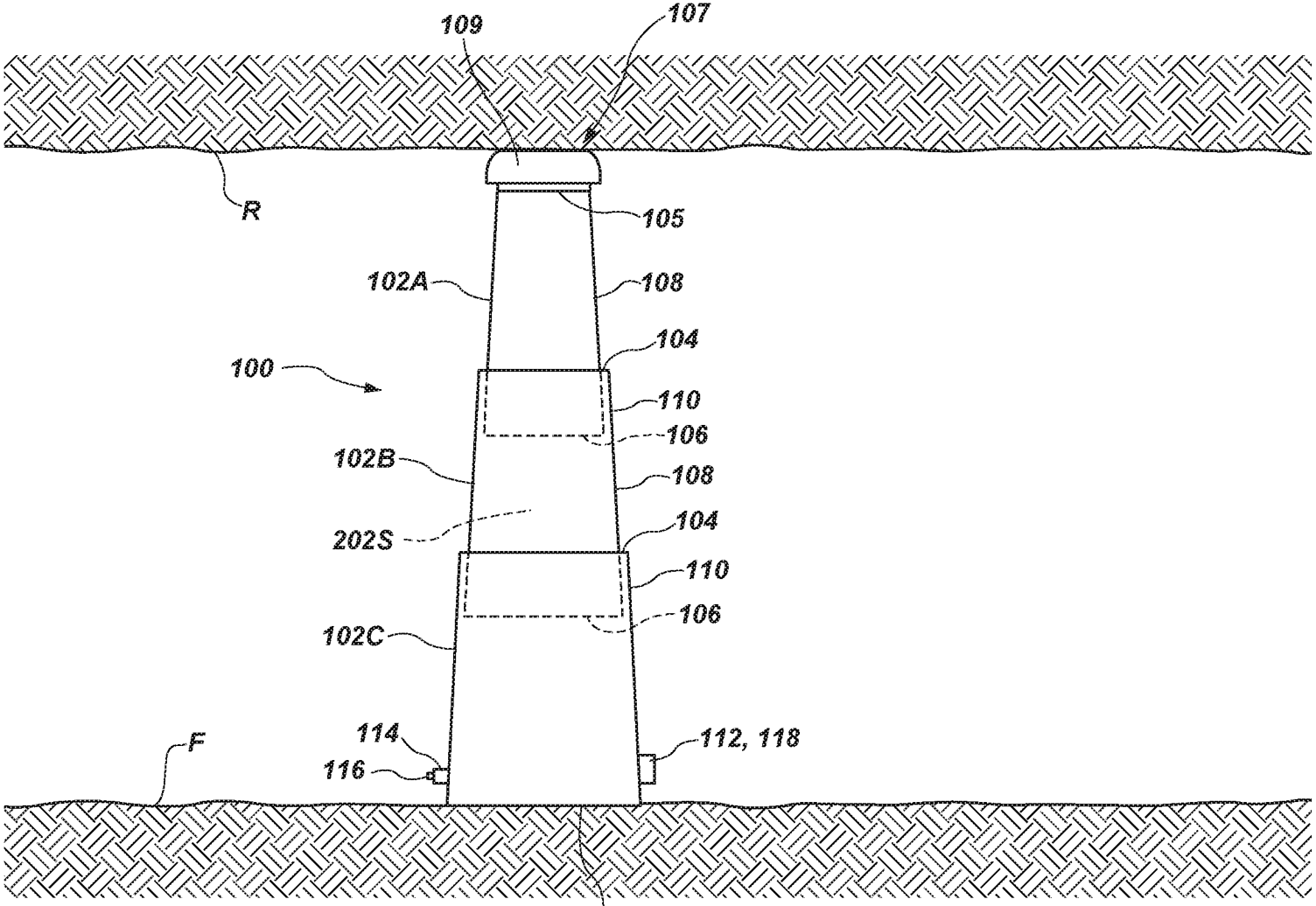
FIG. 1D is a schematic side elevation of an embodiment of a mine roof support of the disclosure as installed between a floor and roof of an underground mine.

FIG. 1D depicts the exterior of mine roof support 100 in place between a floor F and roof R of a room in a mine after hardening of flowable medium 202 to a solid state, providing a continuous, solid, compressible load-bearing filler material 202S within the continuous interior volume of the mine roof support 100. As noted above, if the flowable medium 202 is grout, the grout may or may not be aerated or cellular. If aerated, the continuous, solid, compressible, load-bearing medium may be characterized as an aerated or cellular cementitious material.

Figure 2:
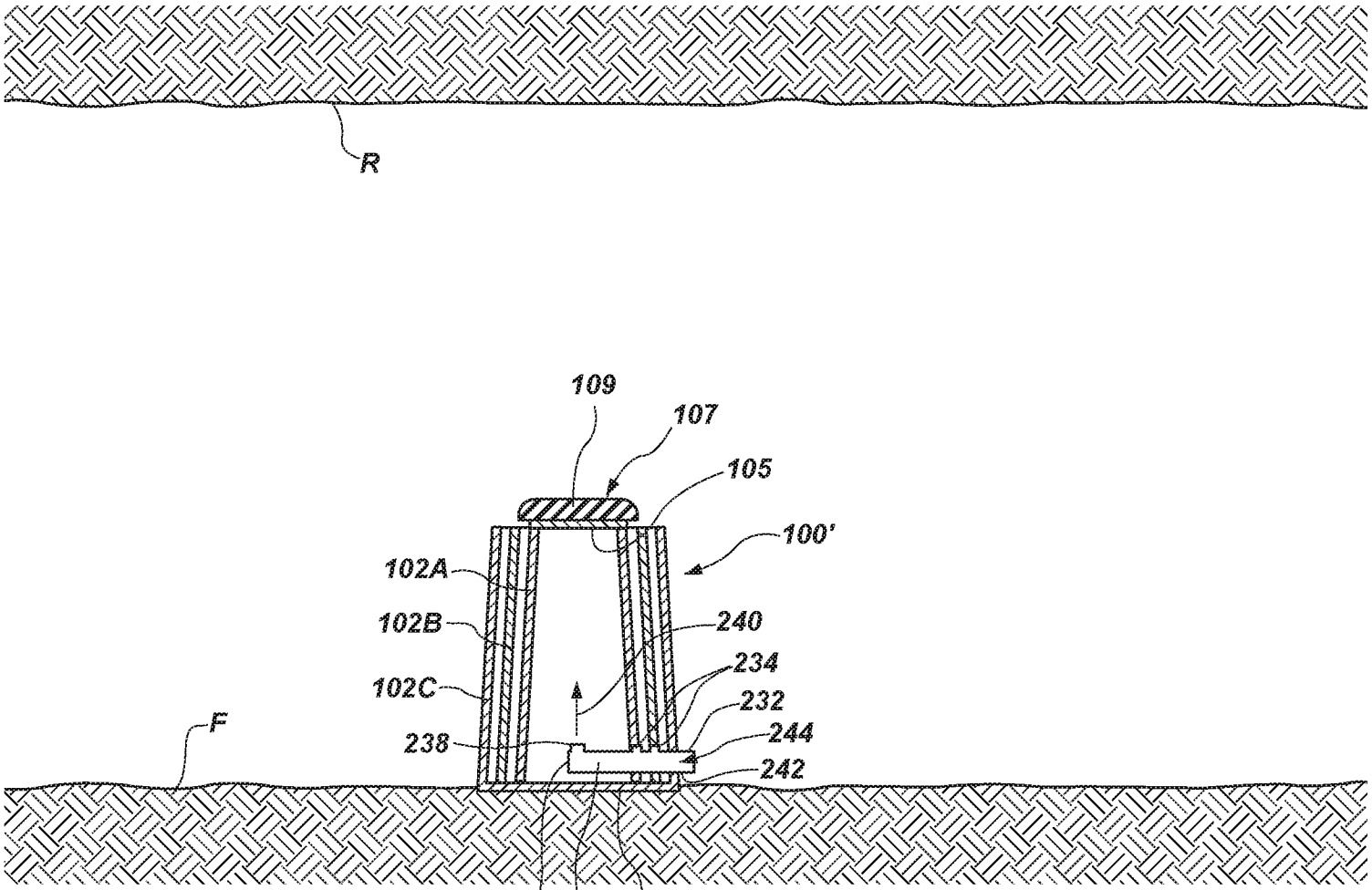
FIG. 2 is a schematic side sectional elevation of an embodiment of a mine roof support of the disclosure as placed in a room of an underground mine for installation.
Figure 3:
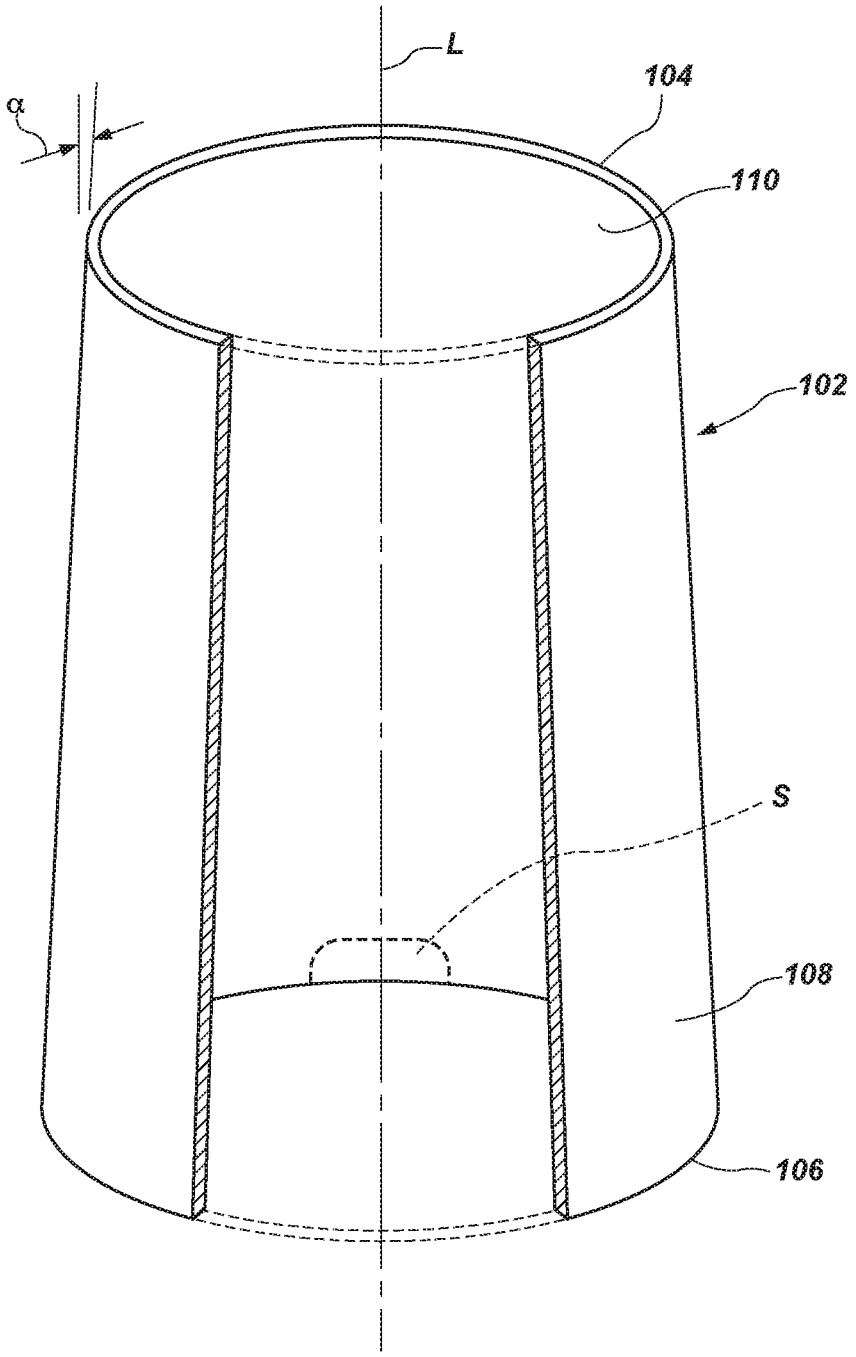
FIG. 3 is an enlarged, partial sectional elevation of a frusto-conical portion of a section of the embodiment of a mine roof support of FIGS. 1A through 1D.

Referring to FIG. 2, another embodiment of a mine roof support 100' of the disclosure is described below. In FIG. 2, elements identical to those previously identified with respect to FIGS. 1A through 1D retain the same reference numeral.

The structure, installation and operation of mine roof support 100' after installation and filled with the same continuous, solid compressible load-bearing medium is substantially the same as that of mine roof support 100. Mine roof support 100' comprises two or more sections 102 of tubular, frusto-conical metal sheathing. Each section 102 may, for example, be formed of steel, rolled into a desired frusto-conical configuration and welded along a seam that extends from an upper end to a lower end thereof to form a truncated conical structure with circular upper and lower ends and no out of round portions significant enough to impair a circumferential frictional substantial interference fit between sections 102 when mine roof support 100' is telescopically extended. A non-limiting example of a suitable metal material for the sheathing is AISI 1008 HRS carbon steel, of between 0.062 in. (16 ga.) and 0.109 in. (12 ga.) wall thickness. As shown, mine roof support 100' comprises three sections, 102A, 102B and 102C, referenced from innermost section 102A to outermost section 102C as nested together in a collapsed assembly on floor F of a room of an underground mine, such as, but not limited to, a coal mine. The configuration of each section 102 is such that an upper end 104 thereof is of slightly smaller diameter than a lower end 106 thereof, and the lower end 106 thereof is of slightly greater diameter than the upper end of a next-outermost section 102. With reference to the longitudinal axis L of the support (see FIG. 3), an acute angle α of departure of a wall 108 of each section is extremely small, on the order of, by way of non-limiting example, about 0.01° to about 3°. Angle α is exaggerated greatly in FIGS. 2 and 3 for clarity, as is the thickness of the metal sheathing of sections 102A-102C. Each of sections 102A, 102B and 102C may be of substantially the same height and exhibit substantially the same angle α of departure. Outermost section 102C, of largest diameter, may have a floor 103 of the same metal material as the metal sheathing, welded at its perimeter to the lower end of section 102C. Similarly, innermost section 102A, of smallest diameter, may have a cap 105 of the same metal material as the metal sheathing, welded at its perimeter to the upper end 104 of section 102A. In addition, a cover 107 of a relatively thick (e.g., three to four inches) solid compressible material may be secured over cap 105 by, for example, an adhesive. In some embodiments, cover 107 may comprise an inflatable grout bag of, for example, a high-strength geotextile, to be inflated (i.e., filled) independently from mine roof support 100' with a cementitious material, aerated or unaerated, or a self-hardening foam, once mine roof support 100' is extended into close proximity with mine roof R. Alternatively, the grout bag may be inflated through an aperture in cap 105, the aperture being closed by a rupturable diaphragm designed to rupture at a predetermined pressure responsive to full extension of mine roof support. In other embodiments, the cover 107 may comprise, for example, wood, or a preformed high density foam material such as, for example, a polyurethane. In some embodiments, cap 105 may be sized to correspond to a mouth of an upper end 104 of section 102A and include a downwardly extending annular skirt configured to fit snugly over the upper end of section 102A to facilitate welding of cap 105 to the wall 108 of section 102A. FIG. 3 does not show floor 103, cap 105 or cover 107, depicting only a frusto-conical portion of sections 102A, 102B and 102C.

Still referring to FIG. 2, mine roof support 100' differs from mine roof support 100 in that the interior volume of mine roof support 100' may be filled with a flowable medium 202 under pressure through a conduit 230 extending from one-way valve 232 (i.e., a check valve) proximate the wall of outermost section 102C laterally inwardly through slots 234 (see also FIG. 3) in the lower ends 106 of sections 102A and 102B to a central region of innermost section 102A. The innermost end 236 of conduit 230 may be configured with an upward-facing outlet 238 to direct flowable medium 202 upwardly as depicted by arrow 240. The outermost end 242 of conduit is affixed to the wall 108 of outermost section 102C and a coupling 244 is associated with one-way valve 232 for connection to a conduit 208 connected to pump 200 drawing flowable medium from flowable medium source 204 through conduit 206 (see FIG. 1B). Installation of mine roof support 100' is substantially identical to installation of mine roof support 100, as is filling of mine roof support 100' with flowable medium 202 pressurized by pump 200 and transmitted to mine roof support 100' through conduit 208. Flowable medium 202 may be more precisely delivered to the interior of innermost section 102A using the conduit 230. When pumping is ceased, one-way valve 232 prevents backflow of flowable medium 202 from the interior of mine roof support 100' until flowable medium 202 solidifies into a continuous, solid, compressible, load-bearing filler material 202S (see FIG. 1C).

Mine roof supports according to embodiments of the disclosure may be designed to carry an average load of at least between about 100,000 lbs. and about 350,000 lbs., depending upon the size of the support. An aerated cementitious material such as, for example, foamed concrete having a density between about 40 to 60 lb./ft.$^3$ may be employed as a filler material. The mine roof support will yield longitudinally when subjected to a longitudinal load during subsidence of a mine roof. Yielding is effected by compression of the foamed grout filler material, collapsing air or gas pockets in the foam matrix, in combination with one or more of the frusto-conical sections 102 of mine roof support 100 folding upon itself in multiple folds, which may also be characterized as wrinkles, as the filler material compresses.

Figure 4:
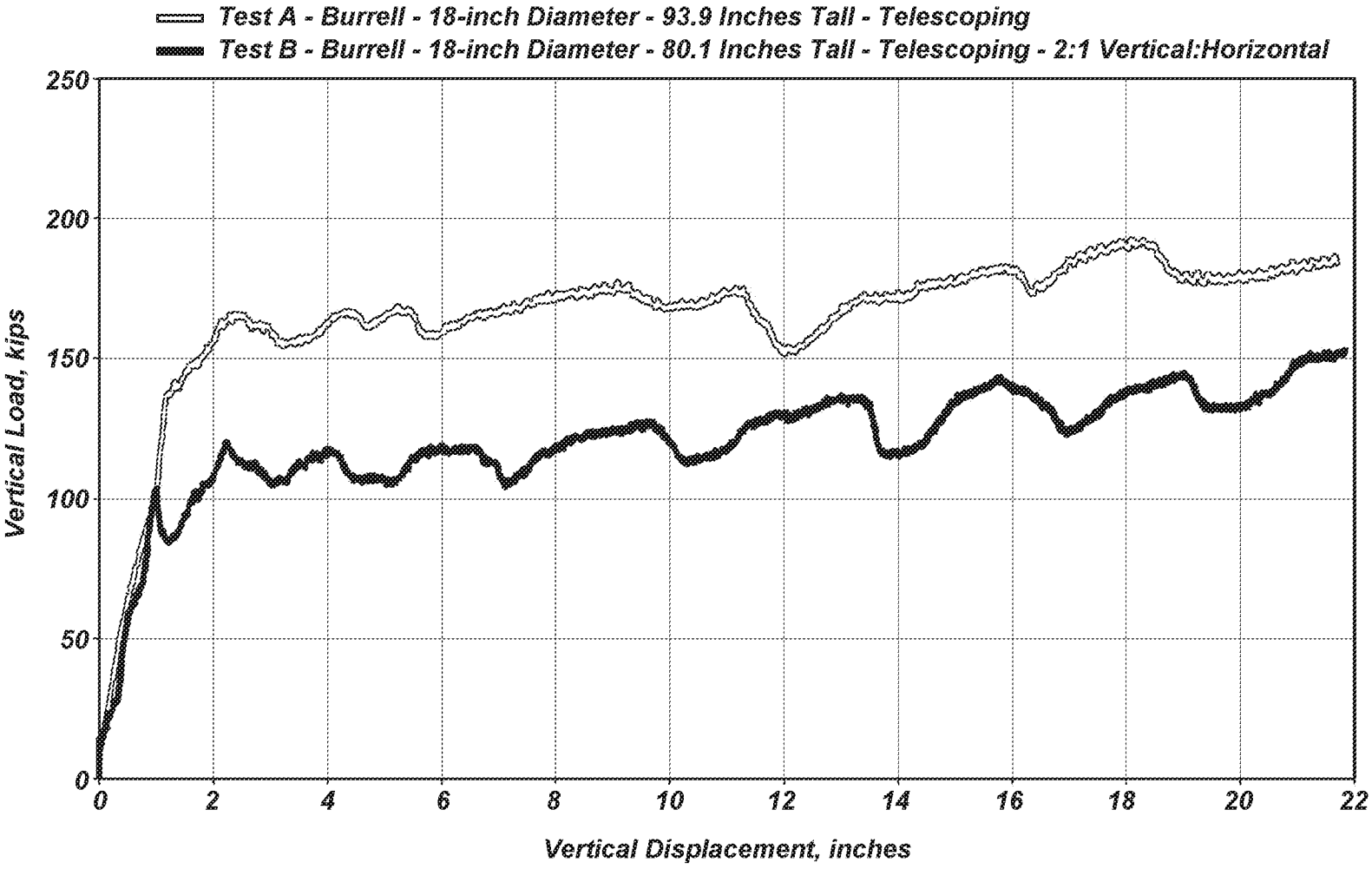
FIG. 4 is a graph of results of tests of mine roof support similar to embodiments of the disclosure at the NIOSH Safety Structures Testing Laboratory.

FIG. 4 is a graphical representation of actual test results for two tests of mine roof supports generally configured according to embodiments of the disclosure as conducted at the National Institute for Occupational Safety and Health (NIOSH) Pittsburgh Mining Research Division Laboratory, Pittsburgh, Pa. Each mine roof support was comprised of three (3) frusto-conical sections filled with an aerated grout, the grout then being allowed to cure. In test A the mine roof support metal sheathing was formed of 0.078 in. (14 ga.) AISI 1008 HRS carbon steel and filled with an aerated grout of about 45 lb./ft.$^3$ density. The support had a nominal diameter of eighteen inches, and an initial height of 93.9 inches. After less than two inches of compression in a test apparatus, the mine roof support was able to bear a load of about 150 kips, which load bearing capacity was maintained or even increased to over 175 kips over a total yield range of almost 22 inches, at which point the test was concluded. In test B the mine roof support metal sheathing was formed of 0.078 in. (14 ga.) AISI 1008 HRS carbon steel and filled with an aerated grout of about 45 lb./ft.$^3$ density. The support had a nominal diameter of eighteen inches, and an initial height of 80.1 inches. After substantially less than two inches of compression in the test apparatus, the mine roof support was able to bear a load of about 100 kips, which load bearing capacity was maintained and then increased to about 150 kips toward the end of a total yield range of about 22 inches, at which point the test was concluded. Each mine roof support tested was able to support a significant load after less than two inches of compression. Significantly, for Test B the test apparatus upper plate moved one inch horizontally for each two inches of downward vertical movement during compression, simulating relative movement of an actual mine room roof with respect to a mine floor while the test mine roof support maintained and even increased load bearing capacity.

Each of the above-referenced mine roof supports differed from the embodiments disclosed herein only in that the uppermost tubular section of each support was open, and not closed with a cap or a cap having a cover thereon. Each mine roof support was telescopingly extended, anchored to a roof and subsequently filled with grout.

Each mine roof support tested yielded in a predictable manner while supporting a load, and yielded only a short distance before substantial load bearing capacity was reached. As shown in FIG. 4 by the wave-like configuration of the graphed results, in each test the load bearing capacity varied as the mine roof support was compressed responsive to folding or wrinkling of the metal sheathing on itself. As the metal sheathing folds, the load bearing capacity of the mine roof support slightly decreases, whereas when a fold has been formed, the load bearing capacity increases. However, the decreases and increases in load bearing capacity are maintained within a predictable, relatively narrow range. In some instances, after installation a section 102 of a mine roof support 100 or 100' may be driven downwardly a short distance into continuous, solid compressible load-bearing filler material 202S in a controlled manner to provide a controlled yield with the mine roof support in lieu of or in addition to folding or wrinkling of the metal sheathing.

The mine roof support of the disclosure, in various embodiments, is also believed by the inventor herein to accommodate some relative lateral shifting between a roof and a floor of a mine room in which the mine roof support is placed without significant loss in load bearing capacity.

The mine roof support of embodiments of the disclosure provides a short, lightweight, compact, easy-to-transport pre-installation assembly which can be more easily placed in a room of an underground mine than many existing supports which, as transported and placed in a mine, must approximate the height of the roof above the mine floor. In addition, the telescoping nature of the assembly, when extended in a telescoping manner responsive to introduction of a flowable medium 202 in the form of a flowable filler material precursor such as an aerated or unaerated grout or another flowable material (e.g., a polymer material formulated to foam) enables accommodation of some variation of distance between the mine floor and roof and substantially automatic contact and intimate engagement with mine roof support 100 without the use of wooden cribbing or other spacing materials and without the use of bolts or other fasteners to secure mine roof support 100 against roof R of a mine room prior to introduction of a flowable filler material precursor. Further, the frusto-conical configuration and mutual frictional engagement of the mine roof support sections in a substantial interference fit enables a substantially fluid-tight seal between the sections of the support without the use of sealing elements of any type.

While particular embodiments of the disclosure have been shown and described, numerous variations and alternative embodiments are contemplated by the inventors herein and will be recognized by those of ordinary skill in the art. Accordingly, the scope of the invention is only limited by the appended claims and their legal equivalents.

What is claimed is:

1. A mine roof support, comprising:

two or more frusto-conical, tubular sections, the sections each flared outwardly from an upper end to a lower end thereof, an entire exterior circumference of a longitudinally extending skirt portion of a section being received and secured within an entire interior circumference of a longitudinally extending neck portion of a section below in a frictional fit providing a substantially fluid-tight seal between sections to define a continuous interior volume of the mine roof support, wherein an uppermost section of the two or more frusto-conical sections comprises a cap continuously secured at a perimeter thereof to an upper end of the uppermost section and closing the uppermost section proximate an upper end thereof, and a lowermost section of the two or more sections comprises a floor continuously secured at a perimeter thereof of a lower end of the lowermost section and closing the lowermost section proximate the lower end; and a continuous, solid, compressible, load-bearing material located within the continuous interior volume and in direct contact with interior surfaces of the cap, the sections and the floor.

2. The mine roof support of claim 1, wherein the two or more frusto-conical tubular sections comprise three frusto-conical tubular sections.

3. The mine roof support of claim 2, wherein each of the three frusto-conical tubular sections is of substantially the same height.

4. The mine roof support of claim 1, further comprising a cover comprising a compressible material over and secured to the cap.

5. The mine roof support of claim 1, wherein the continuous, solid, compressible load-bearing material comprises a cementitious material.

6. The mine roof support of claim 5, wherein the continuous, solid, cementitious material comprises an aerated or cellular cementitious material.

7. The mine roof support of claim 1, wherein each section is flared outwardly at substantially a same angle $\alpha$ of departure to a longitudinal axis of the section.

8. The mine roof support of claim 7, wherein the angle $\alpha$ of departure is between about 0.01° and about 3°.

9. The mine roof support of claim 1, wherein a lowermost one of the two or more frusto-conical tubular sections includes an inlet port coupling configured for connection to a conduit for delivering a flowable filler material precursor of the solid, compressible load-bearing material into an interior of the mine roof support.

10. The mine roof support of claim 9, further including a valve configured to enable prevention of flowable filler material exiting the interior of the mine roof support through the inlet coupling.

11. The mine roof support of claim 10, wherein the valve comprises one of a check valve, a ball valve or a gate valve.

12. The mine roof support of claim 9, further including another conduit extending into the mine roof support from the inlet port to a central region of the interior thereof, the another conduit terminating at an upwardly facing outlet.

13. The mine roof support of claim 12, wherein frusto-conical tubular sections inward of the outermost section are each configured with a slot in a lower end of a wall thereof, the slots aligned with the another conduit to permit passage inwardly of the another conduit prior to extension of the mine roof support.

14. The mine roof support of claim 1, wherein one of the two or more frusto-conical tubular sections includes a vent assembly configured to release pressure within the mine roof support in excess of a predetermined threshold pressure.

15. The mine roof support of claim 14, wherein the vent assembly comprises an overpressure valve including a spring-biased plunger.

16. A method of installing a mine roof support, comprising:

placing a mine roof support comprising an assembly of at least two sections in an installation location within a room of an underground mine, each of the at least two sections of frusto-conical configuration and flared outwardly from an upper end to a lower end thereof, at least one of the at least two sections being nested within at least one other of two or more sections, an outermost section of the at least two sections having a floor continuously secured at a perimeter thereof to the outermost section and closing the outermost section proximate a lower end thereof and an innermost section of the at least two sections having a cap continuously secured at a perimeter thereof to the innermost section and closing the innermost section proximate an upper end thereof; and introducing a flowable filler material precursor of a solid, compressible, load-bearing material directly into an interior of the assembly under pressure to contact inner surfaces of the cap, the sections and the floor and cause an innermost section of the at least two sections to move upwardly in a telescoping manner within a next adjacent section until an entire exterior circumference of a longitudinally extending outer wall surface of the lower end of the innermost section contacts and frictionally engages with an entire exterior circumference of a longitudinally extending inner wall surface of the upper end of the next adjacent section to secure the innermost section to the next adjacent section and effect a substantially fluid-tight seal therebetween.

17. The method of claim 16, wherein the at least two sections comprise three sections, and a section intermediate the innermost section and an outermost section is moved upwardly in a telescoping manner by the flowable filler material precursor of a solid, compressible, load-bearing material introduced under pressure until an entire exterior circumference of a longitudinally extending outer surface of the lower end of the intermediate section contacts and frictionally engages with a longitudinally extending inner surface of the outermost section within an entire interior circumference of the outermost section to secure the intermediate section to the outermost section.

18. The method of claim 16, further comprising extending the mine roof support along a longitudinal axis thereof to contact a roof of the room.

19. The method of claim 16, wherein introducing a flowable filler material precursor of a solid, compressible, load-bearing material comprises introducing a slurry of cementitious material.

20. The method of claim 19, wherein introducing a slurry of cementitious material comprises introducing an aerated or cellular cementitious material.

21. The method of claim 16, further comprising sizing the at least two sections so that, when the sections are mutually extended and frictionally engaged, a height of the mine roof support approximates a height of a roof of the mine room above a floor of the mine room.

22. The method of claim 16, wherein introducing a flowable filler material precursor of a solid, compressible, load-bearing material into an interior of the assembly under pressure comprises introducing the flowable filler material precursor into a central region of the nested assembly through a conduit extending into the mine roof support from an exterior thereof.

23. The method of claim 22, wherein the conduit has an upward-facing outlet.

24. The method of claim 22, wherein the conduit extends to the central region through slots in the lower end of a wall of each section inwardly of the outermost section.

25. A pre-installation assembly for a mine roof support, comprising:

multiple, tubular, frusto-conical sections in a nested arrangement;

a skirt portion of each section defining a larger diameter than a neck portion of a next outer adjacent section, each section being flared outwardly from an upper end to a lower end thereof at substantially the same angle $\alpha$ of departure to a longitudinal axis of the section;

the frusto-conical sections each having a longitudinally extending lower end portion having an entire exterior circumference configured to be captured and frictionally engaged within an entire exterior circumference of a longitudinally extending upper end portion of any next outwardly adjacent frusto-conical section;

an innermost frusto-conical section having a cap welded at a perimeter thereof to an upper end of the innermost frusto-conical section and closing the innermost frusto-conical section proximate an upper end thereof; and an outermost frusto-conical section having a floor welded at a perimeter thereof to a lower end of the outermost frusto-conical section and closing the outermost frusto-conical section proximate a lower end thereof.

26. The pre-installation assembly of claim 25, wherein the angle $\alpha$ of departure is between about 0.01° and about 3°.

27. The pre-installation assembly of claim 25, wherein the outermost section further comprises a vent aperture.

28. The pre-installation assembly of claim 25, wherein the outermost section further comprises an inlet port for receiving a flowable medium into an interior volume of the mine roof support.

29. The pre-installation assembly of claim 28, further comprising a conduit operably coupled to the inlet port and extending inwardly from the outermost section to a central region of the assembly.

30. The pre-installation assembly of claim 29, wherein the conduit extends inwardly to the central region of the assembly through slots in the lower end of a wall of each tubular, frusto-conical section inward of the outermost section.

31. The pre-installation assembly of claim 29, wherein the conduit terminates within the central region with an upwardly facing outlet.

32. The pre-installation assembly of claim 30, further including a one-way valve proximate an outer end of the conduit and configured to prevent flow from out of the interior of the mine roof support.

* * * * *